US008393613B2

(12) United States Patent
Chen

(10) Patent No.: US 8,393,613 B2
(45) Date of Patent: Mar. 12, 2013

(54) MEDIA LEVEL INDICATOR AND PRINTER HAVING SAME

(75) Inventor: Yan-Mei Chen, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 51 days.

(21) Appl. No.: 13/225,566

(22) Filed: Sep. 6, 2011

(65) Prior Publication Data

US 2013/0001871 A1 Jan. 3, 2013

(30) Foreign Application Priority Data

Jun. 29, 2011 (TW) ..... 100122773

(51) Int. Cl.
*B65H 1/00* (2006.01)

(52) U.S. Cl. ..... 271/145; 399/393

(58) Field of Classification Search ..... 399/393; 271/145, 147

See application file for complete search history.

(56) References Cited

U.S. PATENT DOCUMENTS 3,260,402 A * 7/1966 Lareau et al. ..... 221/4
5,028,041 A * 7/1991 Kobayashi ..... 271/9.03
5,572,310 A * 11/1996 Hoberock et al. ..... 399/370
5,692,231 A * 11/1997 O et al. ..... 399/23
6,206,362 B1 * 3/2001 Tan et al. ..... 271/145
6,318,918 B1 * 11/2001 Sasaki et al. ..... 400/624
6,561,506 B2 * 5/2003 Sasaki et al. ..... 271/145
6,869,071 B2 * 3/2005 Amamoto et al. ..... 271/145
7,643,762 B2 * 1/2010 Eto ..... 399/23
7,784,781 B2 * 8/2010 Asada ..... 271/145

* cited by examiner

*Primary Examiner* — Stefanos Karmis
*Assistant Examiner* — Ernesto Suarez
(74) *Attorney, Agent, or Firm* — Altis Law Group, Inc.

(57) ABSTRACT

A media level indicator and a printer having some are disclosed. The printer has the media level indicator, a housing and a media container slidably contained in the housing. The media level indicator includes a media detecting assembly and a level indicating assembly, wherein the media detecting assembly includes a shaft for rotatably engaged with the housing, a detecting arm fixed to the shaft and abutting the top of the paper stack, and a driving arm. The driving arm is articulated with a lever of the level indicating assembly. When the paper amount changes, the detecting arm is moved and drives the media detecting assembly to rotate, which provides motion in an indicating end of the level indicating assembly, which extends outwardly from the media container. Therefore, a change in the paper amount is indicated.

4 Claims, 6 Drawing Sheets

MEDIA LEVEL INDICATOR AND PRINTER HAVING SAME

BACKGROUND

1. Technical Field

The present disclosure relates to a media level indicator for indicating a status of a media stack, for instance, a paper stack, in a media container, and a printer having such media level indicator.

2. Description of Related Art

Nowadays, a printer typically includes a paper storage box inside for storing papers. However, during the printer works, users do not notice if the paper storage is sufficient or not. A conventional printer may alarm users when the paper storage box is out of papers, but an indication of the present amount of the paper storage and a corresponding alarm are not provided. Thus, the printing work may be interrupted suddenly when the paper runs out, which causes a bad user experience and interrupts the working process of the user. As a result, a paper amount indicating function is required.

BRIEF DESCRIPTION OF THE DRAWINGS

The components in the drawings are not necessarily drawn to scale, the emphasis instead being placed upon clearly illustrating the principles of a method of calculating connectivity of an N-dimensional space. Moreover, in the drawings, like reference numerals designate corresponding parts throughout the several views.

DETAILED DESCRIPTION

Figure 1:
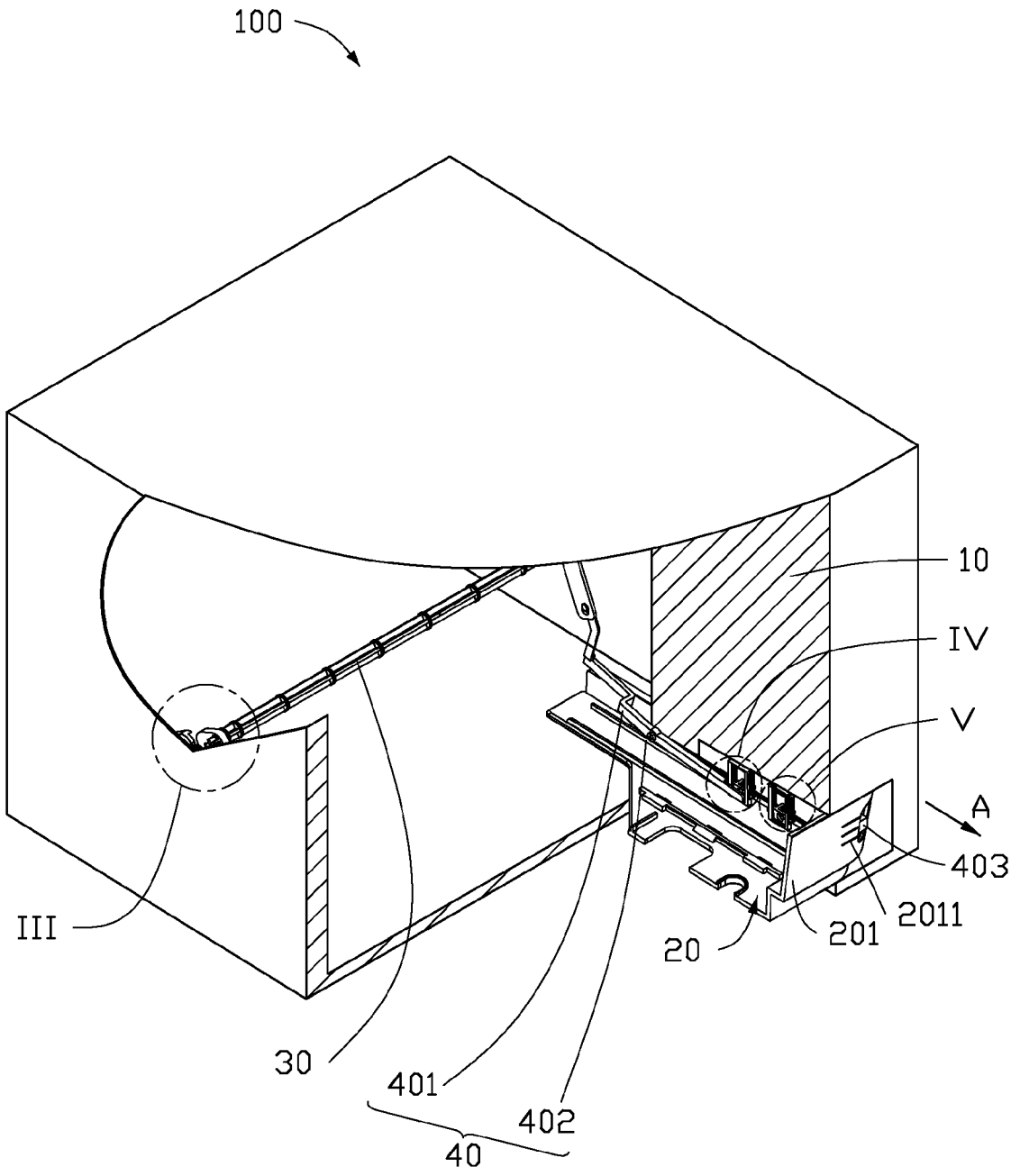
FIG. 1 is an perspective view of an media level indicator, according to an exemplary embodiment of the present disclosure.
Figure 2:
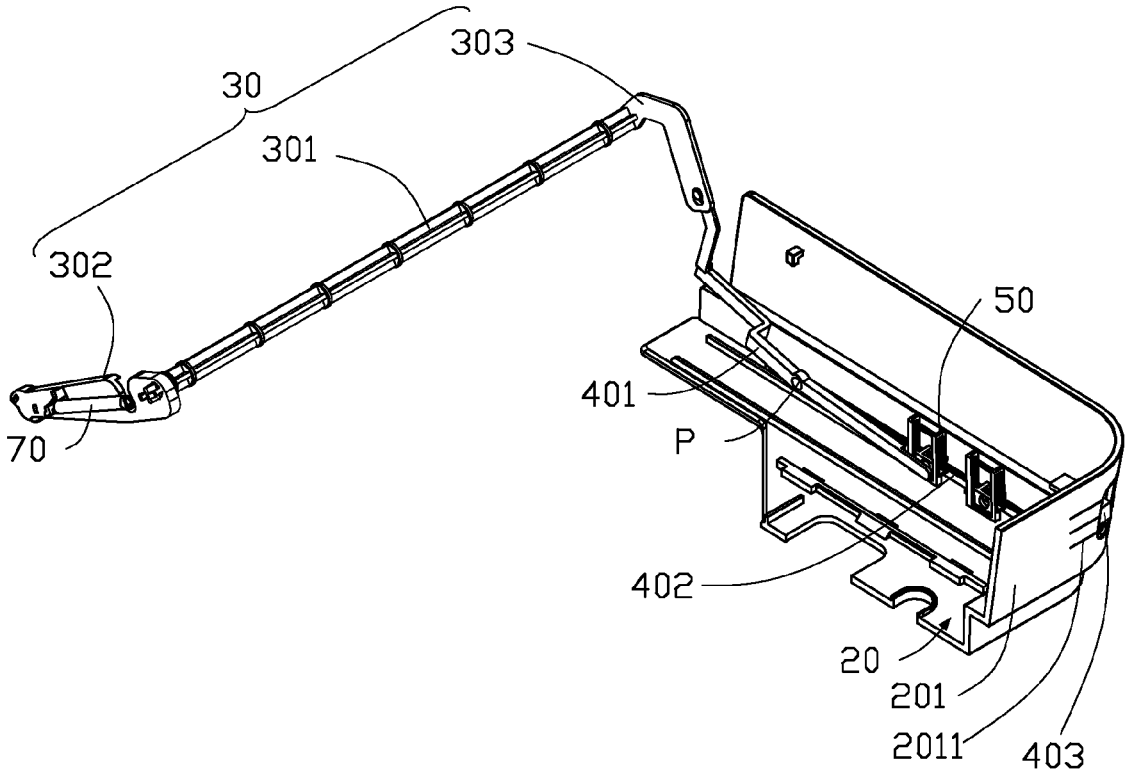
FIG. 2 illustrates the media level indicator without its housing.

Referring to the FIGS. 1-2, an media level indicator and a printer 100 having some, according to an exemplary embodiment, is shown. The printer 100 includes a housing 10, a media container 20 and the media level indicator. The media container 20 is slidably contained in the housing 10, and is to contain a media stack, which is but not limited to a stack of paper, for the printer. The paper stack consists of papers which are stacked vertically. Otherwise, the media container 20 defines an opening.

The media level indicator includes a media detecting assembly 30 and an level indicating assembly 40. The media detecting assembly 30 is composed of a shaft 301, a detecting arm 302 and a driving arm 303, wherein the detecting arm 302 and the driving arm 303 are respectively fixed to the two ends of the shaft 301. The detecting arm 302 is configured for abutting the top of the media stack (not shown), and rotating with and about the shaft 301 in response to the status of the media stack. The driving arm 303 is configured for rotating with the shaft.

The level indicating assembly 40 is composed of a lever 401 and a horizontally oriented media level indicating bar 402. The lever 401 has a first end articulated with the driving arm 303, an intermediate pivot portion P for pivotedly fixed to the housing 10, and an opposing second end. The media level indicating bar 402 has a restricted end and an opposing indicating end 403, wherein the restricted end is mechanically coupled to the second end of the lever 401, and the indicating end 403 is exposed from the media level indicator 100 as a result of extending outwardly from an outer surface 201 of the media container 20, through the opening.

The lever 401 is configured for being driven by the driving arm 303 to rotate about the intermediate pivot portion P, thereby causing the media level indicating bar 402 to be moved jointly with the second end of the lever 401 in a substantially vertical direction to indicate the media lever status.

The media detecting assembly 30 is rotatably connected to the housing 10, as the detecting arm 302 abuts the top of the paper stack and the driving arm 303 articulated with the level indicating assembly 40. Meanwhile, the indicating end 403 extends outwardly from the outer surface 201 of the media container 20. When the thickness of the paper stack increases, the detecting arm 302 is moved upwardly by the top of the paper stack, while the detecting arm 302 drops when the thickness of the paper stack decreases. As a result, the media detecting assembly 30 is driven to rotate, and thus movement is given to the indicating end 403. Since the indicating end 403 is driven to move as the thickness of the paper stack changes, the position of the indicating end 403 indicates to users the amount of the paper stack remaining.

In detailed assembly, the shaft 30 is rotatably engaged to the housing 10, and the lever 401 is pivotedly fixed to the housing 10 through the intermediate pivot portion P. The second end of the lever 401 is slidably disposed on a first guiding structure 50, which defines a vertical path providing for the lever 401 sliding on it. The restricted end of the media level indicating bar 402 is also slidably disposed on the first guiding structure 50, and fixed to the second end of the lever 401. Therefore, the second end of the lever 401 and the restricted end of the media level indicating bar 402, move together on the vertically path created by the first guiding structure 50.

Once the amount of paper in the paper stack changes, the detecting arm 302 is either pushed up or it drops down, driving the shaft 30 to rotate clockwise or anti-clockwise. The lever 401 therefore rotates around the intermediate pivot portion P, leading the second end upwards on the vertical path of the first guiding structure 50, which moves the restricted end therewith. As a result, the visible indicating end 403 of the media level indicating bar 402 is also moved.

For example, when the height of the paper stack decreases in use, the detecting arm 302 drops down, making the shaft 301 rotate and the driving arm 303 rotate therewith. Therefore, the joint point of the lever 401 and the driving arm 302 is lifted, leading the second end of the lever 401 (slidably disposed on the first guiding structure 50) to move down. As a result, the media level indicating bar 402 moves down on the vertical path of the first guiding structure 50, and indicates to users the gradual reduction of the storage papers.

In this embodiment, the media container further comprises a media level scale 2011, is arranged on the outer surface 201 of the media container 20 and is adjacent to the opening. The media level scale 2011 is an approximate indication to users concerning the current amount of the storage papers. As shown and for example, when the indicating end 403 points to the lowest scale, the amount of the storage papers is zero; when the indicating end 403 points to the medium scale, the amount of the storage papers may be 200; and when the indicating end 403 points to the highest scale, the amount of the storage papers may be 400.

Figure 3:
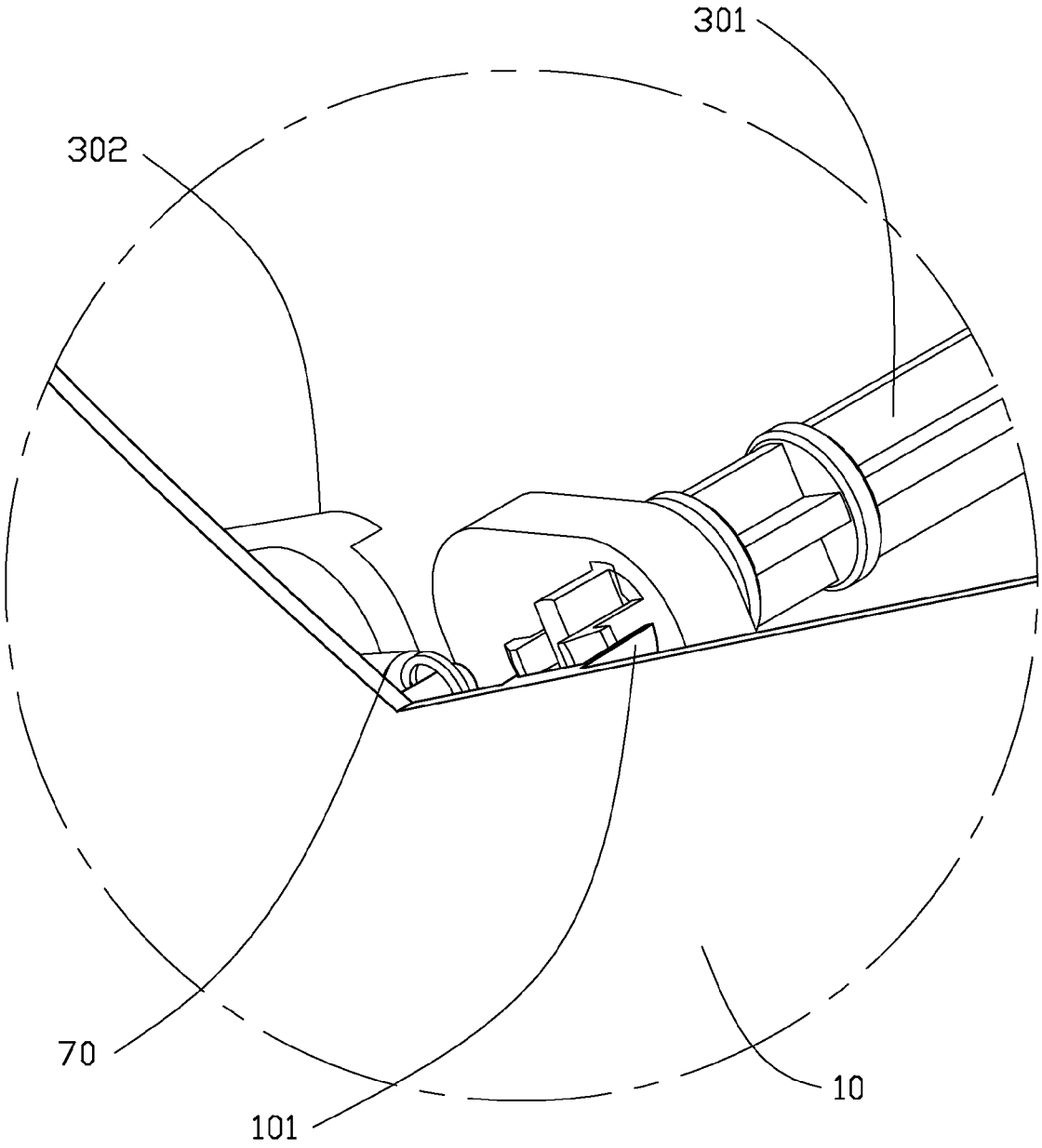
FIG. 3 is an enlarged view of the circle IIV in FIG. 1.

Referring to FIG. 3, which is an enlarged view of the circle IIV in FIG. 1, the media level indicator further includes a spring member 70. One end of the spring member 70 is for being fixed to the detecting arm 302, and the other end is for being fixed on the housing 10. Therefore, the stability of the rotating of the detecting arm 302 is enhanced. Otherwise, two semicircular receiving concaves 101 respectively corresponding to each end of the shaft 301, is formed on the housing 10. The two ends of the shaft 30 are received in the concaves 101, for reliable rotation of the shaft 30 on the housing 10.

Figure 4:
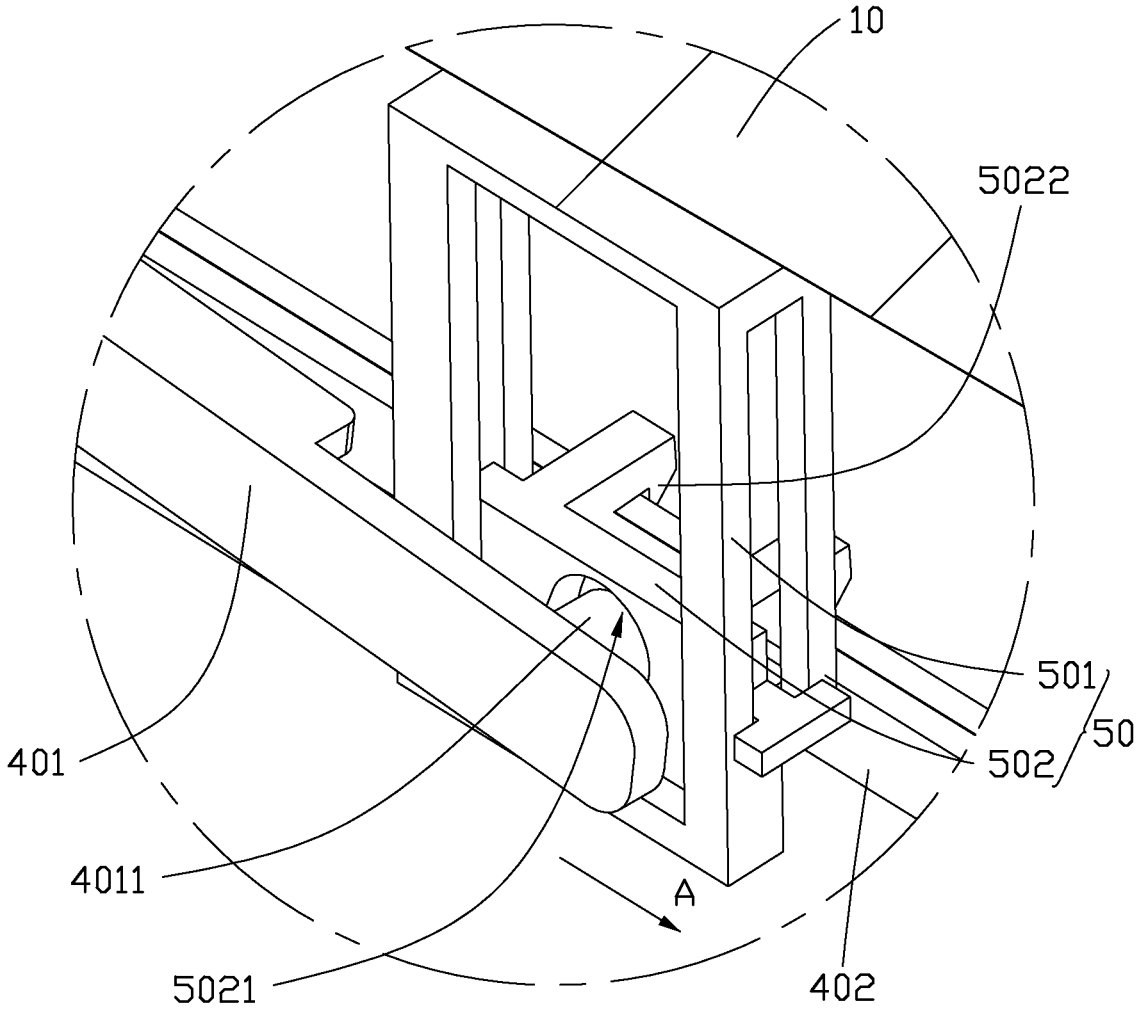
FIG. 4 is an enlarged view of the circle IV in FIG. 1.

Referring to FIG. 4, which is an enlarged view of the circle IV in FIG. 1, the first guiding structure 50 includes a frame 501 and a first hooking portion 502. The frame 501 is fixed on the housing 10 and is formed with a track channel, which defines the above-mentioned vertical path. The first hooking portion 502 is partially contained in the frame 501 and is able to slide along the vertical path. Moreover, the first hooking portion 502 has a hole 5021 and a fixing hook 5022 disposed on the opposed sides of the first hooking portion 502, while the second end of the lever 401 is formed with a protrusion 4011. The protrusion 4011 is received in the hole 5021 to fixedly locate the lever 401 onto the first hook portion 502. The fixing hook 5022 hooks the media level indicating bar 402, and when the first hooking portion 502 moves on the track channel, the media level indicating bar 402 is driven to move within it.

Figure 5:
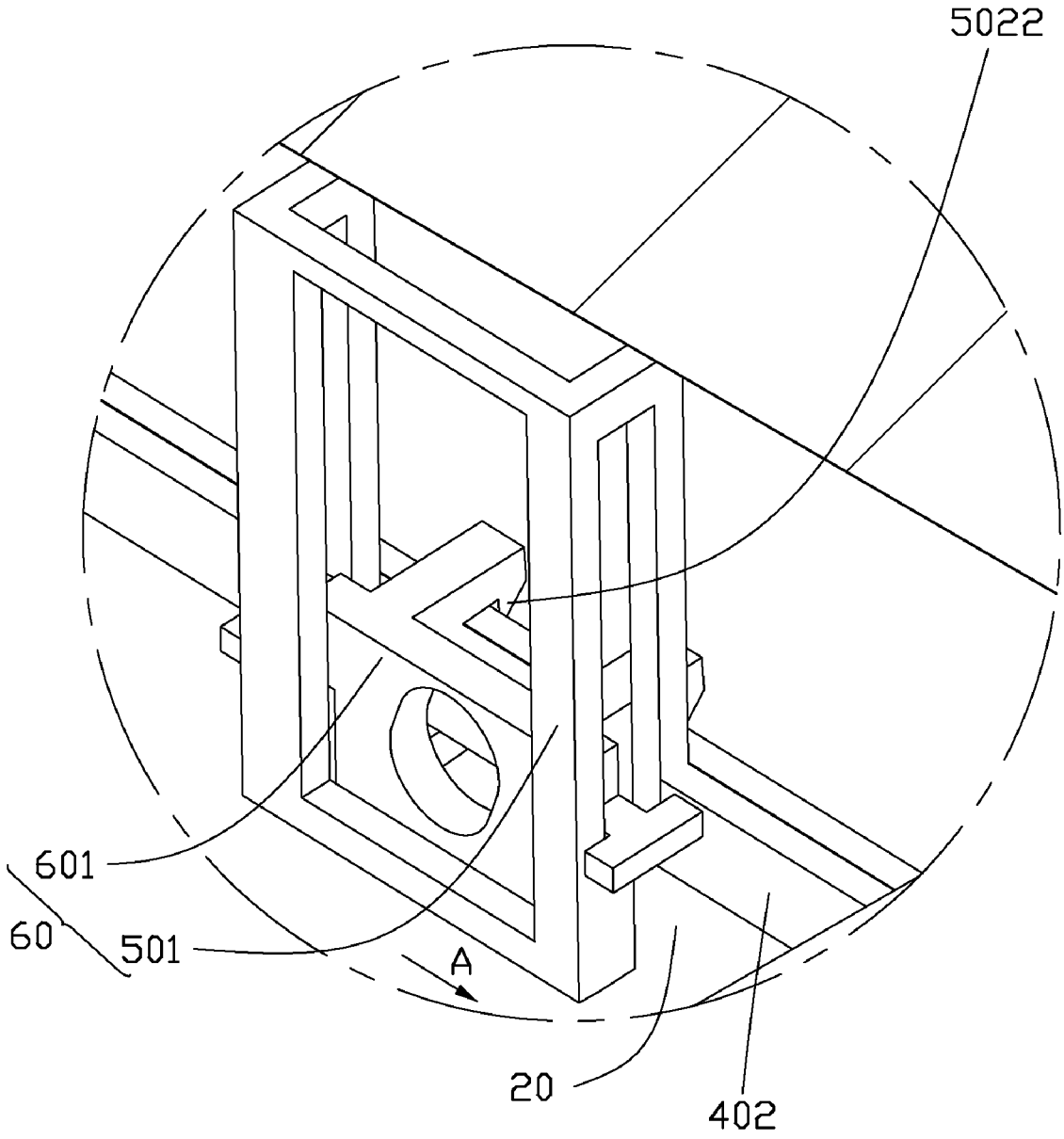
FIG. 5 is an enlarged view of the circle V in FIG. 1.

Referring to FIG. 5, which is an enlarged view of the circle V in FIG. 1, a second guiding structure 60 is added in the media level indicator for stabilizing the motion of the media level indicating bar 402. To distinguish it from the first guiding structure 50, the second guiding structure 60 is disposed on the media container 20 (not the housing 10), and is located between the first guiding structure 50 and the outer surface 201 of the media container 20. Similarly, the second guiding structure 60 includes a frame 501 formed with a track channel and a second hooking portion 601 slidably disposed on the track channel, and the second hooking portion 601 has a fixing hook 5022. The media level indicating bar 402 is hooked by the fixing hook 5022, and can be moved along the direction A to which it is restricted by the fixing hook 5022.

Figure 6:
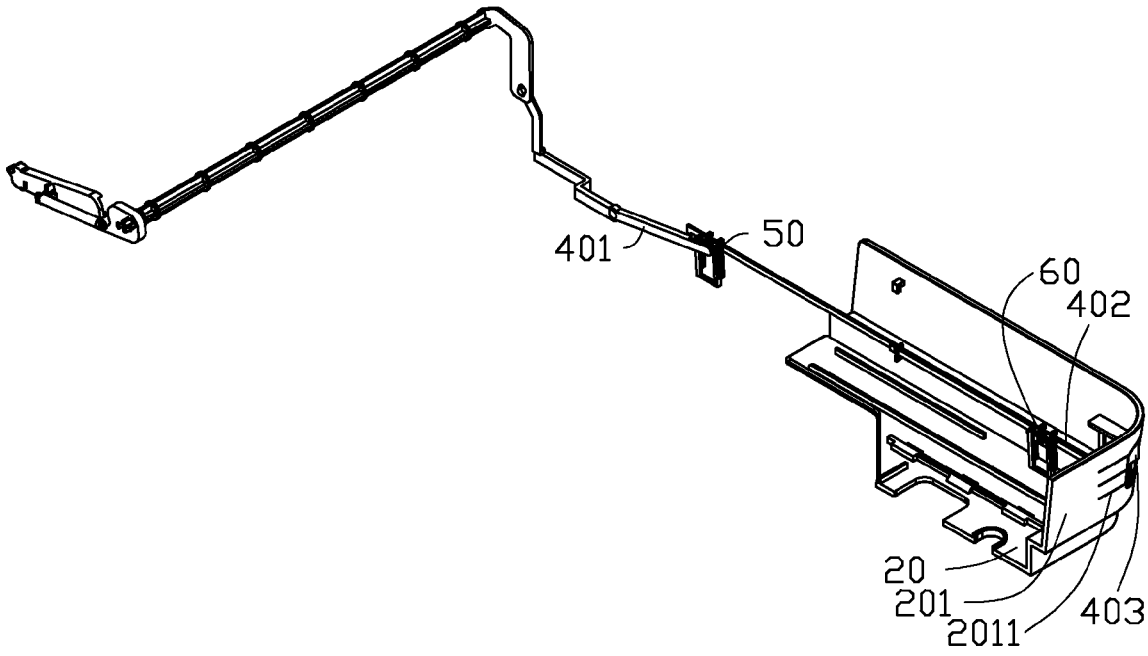
FIG. 6 is a perspective view illustrating the isolated media container.

Referring to FIG. 6, it illustrates the media level indicator with the media container 20 taken out of the housing 10, and is shown without the housing 10 for clarity. When the media container 20 is removed from the housing 10, the media level indicating bar 402 can nevertheless be moved within, as it is restricted by the first hooking portion 502 as well as by the second hooking portion 601.

The media detecting assembly 30 and the level indicating assembly 40 can be replaced with one single rod (not shown). The rod is rotatably disposed in the media container 20, with one end abutting the paper stack and the other end extending outwards from the outer surface 201 of the media container 20.

Although the present disclosure has been specifically described on the basis of this exemplary embodiment, the disclosure is not to be construed as being limited thereto. Various changes or modifications may be made to the embodiment without departing from the scope and spirit of the disclosure.

What is claimed is:

1. A media level indicator for mounting in a printer, the printer including a housing and a media container for containing a media stack, the media level indicator comprising:

a media detecting assembly comprising:

a shaft rotatably engaged with the housing;

a detecting arm fixed to the shaft, the detecting arm configured for abutting the top of the media stack, and rotating with and about the shaft in response to the level status of the media stack; and a driving arm fixed to the shaft and configured for rotating with the shaft; and a level indicating assembly comprising:

a lever having a first end articulated with the driving arm, an intermediate pivot portion pivotedly fixed to the housing, and an opposing second end; and a horizontally oriented media level indicating bar, the media level indicating bar mechanically coupled to the second end of the lever, the lever configured for being driven by the driving arm to rotate about the intermediate pivot portion thereby causing the media level indicating bar to be moved jointly with the second end of the lever in a substantially vertical direction to indicate the media level status.

2. The media level indicator according to claim 1, further comprising a spring member having one end for being fixed to the housing and another end fixed to the detecting arm.

3. A printer comprising:

a housing;

a media container for containing a media stack, the media container slidably received in the housing, the media container defining an opening; and a media level indicator comprising:

a media detecting assembly comprising:

a shaft rotatably engaged with the housing;

a detecting arm fixed to the shaft, the detecting arm configured for resiliently abutting the top of the media stack, and rotating with and about the shaft in response to the level status of the media stack; and a driving arm fixed to the shaft and configured for rotating with the shaft; and a level indicating assembly comprising:

a lever having a first end articulated with the driving arm, an intermediate pivot portion pivotedly fixed to the housing, and an opposing second end; and a horizontally oriented media level indicating bar, the media level indicating bar mechanically coupled to the second end of the lever, the lever configured for being driven by the driving arm to rotate about the intermediate pivot portion thereby causing the media level indicating bar to be moved jointly with the second end of the lever in a substantially vertical direction, the media level indicating bar including a distal end exposed through the opening to indicate the media level status.

4. The printer according to claim 3, wherein the media container comprises a media level scale adjacent to the opening.

* * * * *